US005832688A

United States Patent [19]

Crissey et al.

[11] Patent Number: 5,832,688

[45] Date of Patent: Nov. 10, 1998

[54] LIGHTWEIGHT, PRESTRESSED TOWER

[76] Inventors: Merrill E. Crissey; Glenn C. Crissey, both of 2327 N. El Paso, Colorado Springs, Colo. 80907

[21] Appl. No.: 702,988

[22] Filed: Aug. 28, 1996

[51] Int. Cl.[6] ..... E04H 12/00

[52] U.S. Cl. ..... 52/651.01; 52/651.07; 52/651.02; 52/651.05; 52/651.06; 52/652.1; 52/638

[58] Field of Search ..... 52/651.01–651.07, 52/652.1, 637, 638

[56] References Cited

U.S. PATENT DOCUMENTS

| | | | |
|---|---|---|---|
| 125,771 | 4/1872 | Trego | 52/638 |
| 1,054,737 | 3/1913 | Woodbury et al. | 52/638 |
| 2,982,379 | 5/1961 | Fisher | 52/638 X |
| 3,611,652 | 10/1971 | Rabenhorst et al. | 52/110 |
| 3,634,989 | 1/1972 | Rogers | 52/584 |
| 4,334,391 | 6/1982 | Hedgepeth et al. | 52/108 |
| 5,367,852 | 11/1994 | Masuda et al. | 52/651.06 |

*Primary Examiner*—Creighton Smith
*Assistant Examiner*—W. Glenn Edwards
*Attorney, Agent, or Firm*—Phillip A. Rein

[57] ABSTRACT

A lightweight, prestressed tower includes 1) a base load transfer assembly to be mounted on a support base fixture assembly which is mounted on a base support pad; 2) a primary truss assembly consisting of a plurality of truss bays interconnected by diagonal and vertical tension members between horizontal frame assemblies; 3) a central compression tube assembly operable to be extended centrally of the truss bays from bottom to top having tubular sections connectable to each other to provide a central compression load assembly; and 4) an upper load transfer assembly connected to an upper end of the central compression tube assembly and by horizontal and diagonal tension members of the primary truss assembly. The primary truss assembly with the diagonal and vertical tension members and frame compression tubes is operable to have predetermined tension forces applied thereto through extension of the central compression tube assembly to create desirable load support characteristics. The upper load transfer assembly is operable to receive and support an antenna or other such equipment required to be elevated above a ground support surface for proper operation thereof.

16 Claims, 4 Drawing Sheets

LIGHTWEIGHT, PRESTRESSED TOWER

A patent search was conducted on this invention and the following United States patents are noted:

| U.S. Pat. No. | INVENTION | INVENTOR |
|---|---|---|
| 1,054,737 | EXTENSION SUPPORT | John C. Woodbury and John E. Woodbury |
| 3,486,279 | DEPLOYABLE LATTICE COLUMN | Hagen R. Mauch |
| 3,564,789 | EXTENDABLE-RETRACTABLE BOX BEAM | W. W. Vyvyan et al |
| 3,611,652 | THERMALLY TRANSPARENT ERECTABLE BOOM | D. W. Rabenhorst et al |
| 3,634,989 | MODULAR TOWER | Cyril B. Rogers |
| 4,334,391 | REDUNDANT DEPLOYABLE LATTICE COLUMN | Hedgepeth et al |
| 4,480,415 | EXTENDABLE STRUCTURES | Peter Truss |
| 4,557,097 | SEQUENTIALLY DEPLOYABLE MANEUVERABLE TETRAHEDRAL BEAM | Mikulas, Jr. et al |
| 4,587,777 | DEPLOYABLE SPACE TRUSS BEAM | Vasques et al |

ANALYSIS

The Vasques et al patent discloses a space truss beam that is constructed of heavyweight struts used to support a number of communication antennas from a common hub.

The Woodbury et al patent discloses an extension support using triangular spaced, parallel support members interconnected by cables with turnbuckles thereon. The tapered, assembled tower is not prestressed and requires guy members to hold in a vertical, erected condition.

The Mauch patent discloses a deployable lattice column having a collapsed column being extendable. A plurality of guy wires are needed to anchor the tower assembly to a support surface to prevent toppling.

The Vyvyan et al patent discloses an extendable-retractable box beam which is of generally heavyweight rigid tubular construction having tube members interconnected by cables.

The Rabenhorst et al patent discloses a thermally transparent erectable boom using diagonal wires and corner wires with horizontal struts. The boom is expandable from a collapsed to a deployed position but the diagonal wires are not secured to outer ends of the horizontal struts.

The Rogers patent discloses a modular tower of heavy tubular construction.

The Hedgepeth et al patent discloses a redundant deployable lattice column which is usable in space utilizing cable members and triangular horizontal support members. This column does not have a central compression tube assembly nor prestressed.

The Truss patent discloses extendable structures being of triangular shape having three spaced longerons which are connected to triangular support assemblies which, in turn, are interconnected to tension wires. This patent does not disclose upper and lower load transfer structures to achieve the final assembled condition under prestressed conditions.

The Mikulas, Jr. et al patent discloses a sequentially deployable maneuverable tetrahedral beam which is of a solid tubular construction without a central support compression tube and not prestressed.

BACKGROUND OF THE INVENTION

The present invention relates to a prestressed tower structure and more particularly to a tower characterized by less area subject to wind loading, less weight, less material and manufacturing cost, more compact size and weight for shipping and greater resistance to bending and torsional loading than previously designed conventional towers now in use.

Towers now available are generally fabricated by welding steel or aluminum tubes into 8 ft to 10 ft. triangular truss sections of uniform cross-sectional size which are bolted together to form a tower. Many of these towers must be guyed to support horizontal loads. The guys add significantly to the vertical loads the tower and foundation must support, add cost for the guy cables and dead men that anchor them and require large site areas to accommodate the guyed tower. Most of the individual sections are not uniformly tapered, adding to the area subject to wind loading over that of a uniformly tapered tower. Since the minimum length of most available tower sections is 8 ft., the methods of shipment are limited to costly, time consuming methods. Shear and torsion in conventional towers are resisted by a single diagonal rod in each tower face, requiring the rod to resist both tension and compression, thus increasing its size. Anti-torsion guys are often required in current towers due to the lack of torsional resistance of these towers as required for stability of microwave antennae. The cost of conventional steel towers now in use is increased by the need for galvanizing of all steel members to prevent corrosion.

PREFERRED EMBODIMENT OF THE INVENTION

In one preferred embodiment of this invention, a lightweight, prestressed tower, is provided which is mounted on a base support pad preferably constructed of concrete and operable to support an antenna dish, a laterally extended vertical antenna, or other such objects that are required to be elevated for proper operation such as receiving signals from a satellite, radio transmitter, or the like.

The lightweight, prestressed tower includes 1) a base support fixture assembly; 2) a base load transfer assembly; 3) a primary truss assembly which can be assembled in individual units and interconnected to each other; 4) a central compression tube assembly interconnected to and laterally supported by the primary truss assembly; and 5) an upper load transfer assembly connected to the upper end of the central compression tube assembly to provide an equipment support platform.

The base support fixture assembly noted in FIGS. 1 and 4 is operable to secure and pivotally connect the lightweight, prestressed tower to the base support pads and includes 1) a pair of pivot support angles; 2) a pair of pivot fixtures; 3) a corner anchor fixture; and 4) side alignment rods.

The base support fixture assembly is operable to receive the base load transfer assembly thereon and allow the entire lightweight, prestressed tower to be moved from a generally horizontal position during a method of assembly and pivoted 90 degrees to an upward position as noted in FIG. 1 about the pivot fixtures. The lightweight, prestressed tower is anchored in the vertical position by an anchor member in the corner anchor fixture. However, it is noted that the lightweight, prestressed tower can be selectively moved to the horizontal position for adding, receiving, or doing maintenance to antennae or other elements as so desired.

As noted in FIG. 4, the base load transfer assembly, operable to transfer compressive loads from the central compressive tube assembly to support tension loads from vertical and diagonal tension members, includes 1) a central support tube; 2) radial diagonal compression members; 3)

radial horizontal tension members; 4) support rings at the upper and lower ends of the central support tube; and 5) corner anchor block assemblies. All members are interconnected as shown in FIG. 4 and are attached and secured as by welding. The attachment of the corner anchor block assemblies to the top surface of the pivot and corner anchor fixtures is as by welding.

As best shown in FIG. 6, the central support ring assembly includes a lateral support ring having an inner opening to receive the central compression tube assembly therein and ring support rod openings to receive ring support rods to hold the center support ring in a central location.

Each corner anchor block assembly is provided with a main block member having 1) laterally extended cylindrical lugs to support outer end sections of respective frame compression tubes; 2) ring support rod openings to receive the outer end sections of the ring support rods; and 3) a tension member opening operable to receive a plurality of tension members therein to be securely locked therein by an anchor allen screw and an adhesive material.

As noted in FIGS. 4, 5, and 11, the vertical and diagonal tension members in upper and lower truss bays extend to the corner anchor block assemblies of the respective base and upper load transfer assemblies and are then secured by end anchor chuck assemblies at each respective corner.

The primary truss assembly is preferably constructed in sections, consisting of a pair of spaced horizontal frame assemblies interconnected by the diagonal and vertical tension members.

The horizontal frame assembly includes 1) outer frame compression tubes; 2) ring support rods; 3) corner anchor block assemblies having outer ends of the ring support rods and the outer frame compression tubes connected thereto and having a tension member opening to receive the diagonal and vertical tension members therethrough; and 4) a central support ring assembly with a compression tube opening having the central compression tube assembly mounted therein.

The horizontal frame assembly as described above is provided with a second embodiment as noted in FIGS. 3 and 7. More particularly, the second embodiment is provided with a radial horizontal frame assembly having 1) a central hub assembly; and 2) radial compression tubes connected to the central hub assembly and respective ones of corner anchor block assemblies.

The corner anchor block assemblies are provided with a hex anchor block with a central tension member opening therein to receive the diagonal and vertical tension members therethrough to be anchored as by the adhesive material and an anchor allen screw mounted in a transverse threaded hole.

The radial horizontal frame assembly of the second embodiment differs from the horizontal frame assembly as not requiring outer frame compression tubes and, therefore, achieves a savings in material but requiring rigid ones of the inner radial compression tubes to provide the necessary rigidity. Laterally extended cylindrical lugs on the central hub assembly and the hex anchor block are used in order to provide the necessary support and rigidity to the inner radial compression tubes as noted in FIG. 7.

The central compression tube assembly utilized with both embodiments of the horizontal frame assembly and the radial horizontal frame assembly includes 1) a lower compression tube member; 2) intermediate compression tube members; and 3) an upper compression tube member.

The central compression tube assembly is extended outward against the upper load transfer assembly to prestress the tower by means of an expandable screw assembly which expands in the area between the lower compression tube member and the central support tube of the base load transfer assembly. The expanded adjustable screw can be used to hold the tower in a given spaced, adjusted position, maintaining the prestress forces therein.

The expandable screw assembly includes 1) a main screw member having outer external threads thereon; 2) support washer members mounted on outer ends of the main screw member; and 3) adjustment nut members threadably mounted on respective outer ends of the main screw member and engageable with the support washer members. The respective support washer members are engageable with an upper surface of the central support tube and a lower surface of the lower compression tube member.

The intermediate compression tube members and the upper compression tube member are all provided with an upper section having a reduced portion or alignment insert for interconnection in a telescoping manner to a lower end of an adjacent one of the intermediate compression tube members and the central support tube of the upper load transfer assembly, aligning the interconnected members.

The intermediate compression tube members are each adapted to be telescopingly engageable with adjacent ones thereof with each having a lower connector section and an upper connector section having the alignment insert. The reduced portion or alignment insert is to be mounted within an adjacent lower connector section of an adjacent intermediate compression tube member to provide the central compression tube assembly with a selected overall length. Joints in the central compression tube assembly are located at horizontal frame assembly vertical centerlines.

An upper end of the upper compression tube member is connected to the upper load transfer assembly.

The upper load transfer assembly, as best shown in FIG. 5, includes 1) a triangular support plate; 2) a central support tube; 3) radial diagonal compression tube members; 4) radial horizontal tension tube members; 5) support rings at the top and bottom of the central support tube; and 6) corner anchor block assemblies. All elements of the upper load transfer assembly are interconnected and secured as by welding as shown in FIGS. 9 and 11.

The top plate is a triangular support plate with outer corners each having an end anchor chuck assembly thereon to respectively receive and anchor outer, upper ends of the diagonal and the vertical tension members as noted in FIGS. 5 and 11.

In summary, the lightweight prestressed tower of this invention includes 1) a base support fixture assembly; 2) a base load transfer assembly; 3) an upper load transfer assembly; and 4) a primary truss assembly connected from the base load transfer assembly to the upper load transfer assembly by vertical and diagonal tension members and a series of horizontal frame assemblies having horizontal compression tubes and being mutually perpendicular to the central compression tube assembly.

The base load transfer assembly is utilized with the expandable screw assembly to provide expansion thereof. The required and predetermined tension on the diagonal and vertical tension members and compression of the frame compression tube members is applied to achieve the pre-engineered and selected compression and tension on the various elements thereof when in the assembled vertically erected condition.

OBJECTS OF THE INVENTION

One object of this invention is to provide a lightweight, prestressed tower constructed of lightweight aluminum tubing, solid rods, aluminum castings, and galvanized high strength steel cable or other high strength tendon material, all connected by welding or bonding with adhesive and being economical to manufacture, lightweight in construction, easy to assemble and disassemble, and having a minimum amount of wind resistance.

Another object of this invention is to provide a lightweight, prestressed tower which can be assembled, tested, and manufactured at a manufacturing plant site and readily collapsed and shipped in a compact manner to an erector user thereof whereupon the prestressed tower can be unpacked, expanded, and locked in a fully extended position having prestressed factors engineered therein when in the fully extended compression and tension conditions as constructed and engineered by the manufacturer.

One other object of this invention is to provide a lightweight, prestressed tower having a plurality of truss bays in three faces, each bay consisting of vertical and diagonal tension members between horizontal frame assemblies and having a lower end connected to a base load transfer assembly and an upper end connected to an upper load transfer assembly, all operable in the expanded condition to have prestressed compression and tension forces holding same in the expanded, erected condition.

A further object of this invention is to provide a lightweight, prestressed tower manufactured with lightweight materials and cable tension members to provide minimum wind resistance; being lightweight in construction; easy to assemble and disassemble; and substantially maintenance free.

One other object of this invention is to provide a lightweight, uniformly tapered prestressed tower being lightweight and low cost, constructed with a low wind drag, an easily erectable tower assembly having compact shipping size and great cantilever bending and torsional resistance to support elevated antennae and other devices.

Another object of this invention is to provide a lightweight, prestressed tower being rigidized by prestressing vertical and diagonal cables and compression members in frames by forcing a top upper load transfer assembly away from a base load transfer assembly, forming trusses in three vertical faces or planes.

Still, another object of this invention is to provide a lightweight, prestressed tower providing prestressed sections of a uniformly tapered structure configured to be bolted together to form a very high free-standing tower assembly.

A further object of this invention is to provide a lightweight, prestressed tower which has less projected area than conventional towers, thus lowering wind loading and permitting more antenna area and weight to be supported; has less weight per foot than conventional towers, thus permitting easy erection from a hinged base and reducing the cost of materials; can be reduced to minimum volume for shipping, thus reducing shipping costs; is a simple assembly process in the field, thus permitting it to be erected in remote locations; and is free-standing to great heights, thus eliminating the necessity of guy wires and deadmen anchors which increase the cost of materials and labor and require large land areas for support.

One further object of this invention is to provide a lightweight, prestressed tower which is pretested and engineered at a manufacturing site to various specifications such as wind resistance, top and side loads to be carried thereon, and overall height to determine the necessary engineering conditions to provide a sturdy and rigid prestressed tower for supporting an antenna or other equipment thereon.

Still, one other object of this invention is to provide a lightweight, prestressed tower which is pre-engineered to meet predetermined wind resistance and load requirements; economical to manufacture; easy to ship to a desired location in a collapsed condition; easy to assemble in a horizontal position and readily pivotal to a vertical usage position; and can be erected and installed without the use of expensive tools or skilled labor.

Various other objects, advantages, and features of the invention will become apparent to those skilled in the art from the following discussion, taken in conjunction with the accompanying drawings, in which:

BRIEF DESCRIPTION OF THE DRAWINGS

Details of the invention and of a preferred embodiment thereof will be better understood by reference to the drawings in which.

Figure 1:
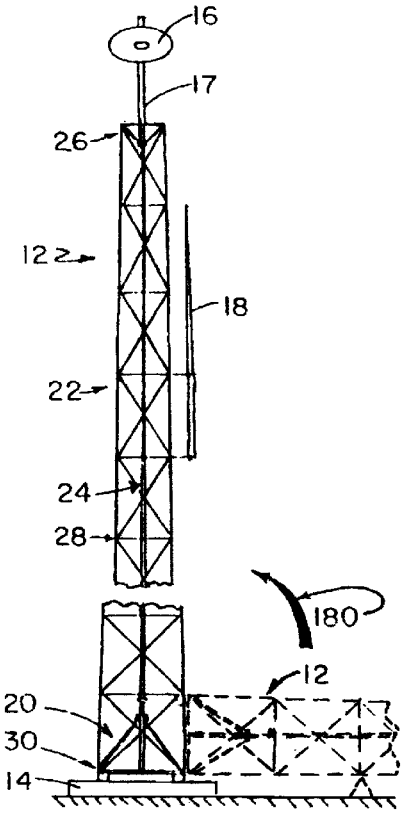
FIG. 1 is a side elevational view of the lightweight, prestressed tower of this invention showing a fragmentary portion in dotted lines in a horizontal condition for initial assembly thereof.

The following is a discussion and description of preferred specific embodiments of the lightweight, prestressed tower of this invention, such being made with reference to the drawings, whereupon the same reference numerals are used to indicate the same or similar parts and/or structure. It is to be understood that such discussion and description is not to unduly limit the scope of the invention.

DETAILED DESCRIPTION OF THE INVENTION

On referring to the drawings in detail, and in particular to FIG. 1, a lightweight, prestressed tower of this invention, indicated generally at 12, is shown as mounted on a support pad 14 which may of concrete or other such construction to provide for a secure mounting base. An antenna 16 on a mast 17, a side mount antenna 18 or other devices requiring stable elevated support can be selectively attached to a respective top portion or an inclined side wall.

In FIG. 1, a portion of the lightweight, prestressed tower 12 is indicated in dotted lines in a horizontal position which would be the main position for assembling and expanding during a method of assembly thereof. The lightweight, prestressed tower 12 can then be moved upwardly to the vertical position as noted by an arrow 180 in FIGS. 1 and 4.

The lightweight, prestressed tower 12 includes 1) a base support fixture assembly 30; 2) a base load transfer assembly 20; 3) a prestressed primary truss assembly 22, consisting of a plurality of bays between horizontal frame assemblies 28; 4) a central compression tube assembly 24; 5) an expandable screw assembly 118; and 6) an upper load transfer assembly 26.

Figure 4:
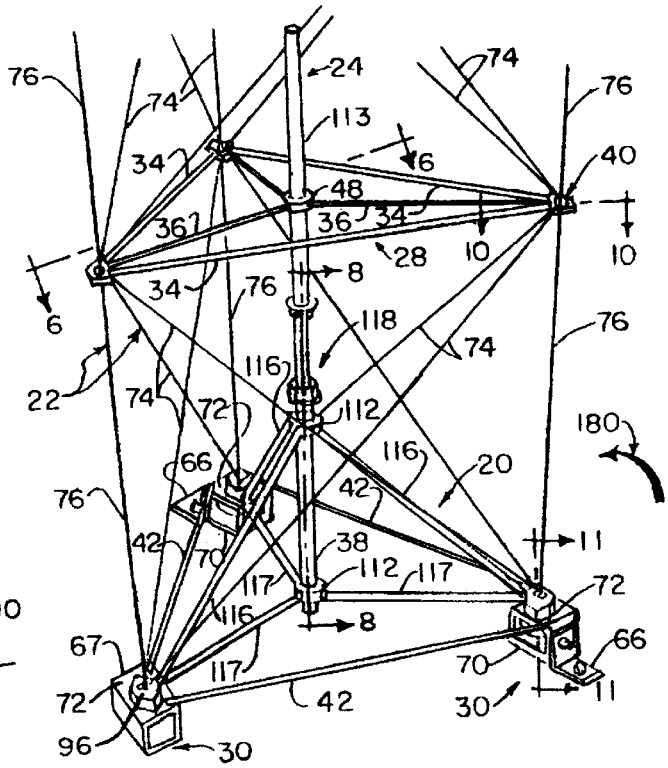
FIG. 4 is a fragmentary perspective view of a lower portion of the lightweight, prestressed tower of this invention.

The base support fixture assembly 30, shown in FIG. 4, is operable to pivotally connect and selectively secure the base load transfer assembly 20 to the base support pad 14.

As shown in FIG. 4, the base support fixture assembly 30 includes 1) a pair of pivot support angles 66; 2) a pair of corner pivot fixtures 70; 3) a corner anchor fixture 67; and 4) side alignment rods 42, secured as by welding to upper fixture surfaces 72 of the corner fixtures 67 and 70. The pivot fixtures 70 are operable to be connected and pivotable about the pivot support angles 66 which are secured as by nut and bolt members to the base support pad 14.

The base load transfer assembly 20 includes 1) a central support tube 38; 2) diagonal radial compression members 116; 3) horizontal radial tension members 117; 4) support rings 112 at the upper and lower ends of the central support tube 38; and 5) corner anchor block assemblies 96 at each exterior corner of the base load transfer assembly 20.

Figure 8:
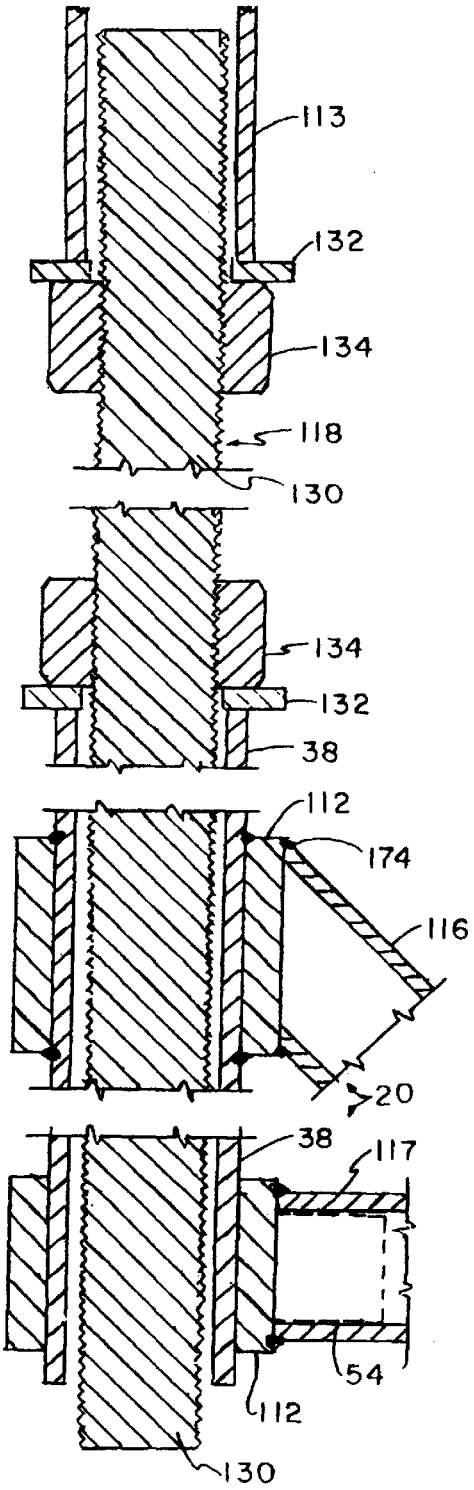
FIG. 8 is an enlarged foreshortened fragmentary sectional view taken along line 8—8 in FIG. 4.

As shown in FIG. 8, the support rings 112 are secured to the central support tube 38 at its respective upper and lower ends as by welding. The inner ends of the compression members 116 and tension members 117 are secured as by welding to the respective support rings 112. The outer ends are secured as by welding to a corner anchor block assembly 96 as shown in an inverted position in FIG. 11.

Figure 6:
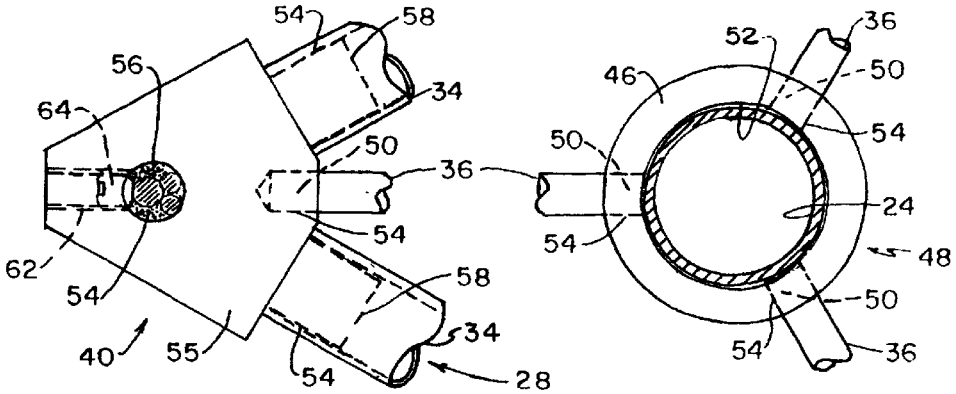
FIG. 6 is a foreshortened fragmentary sectional view taken along line 6—6 in FIG. 4.

As shown in FIG. 6, each corner anchor block assembly 40 is provided with a main block member 55 having 1) a tension member opening 56 to receive diagonal tension members 74 and a vertical tension member 76; 2) cylindrical lugs 58; 3) support rod openings 50; 4) a transverse threaded hole 62 extended perpendicular to the tension member opening 56; and 5) an anchor allen screw 64 threadably mounted within the threaded anchor hole 62 and is operable to be selectively engageable with the diagonal and vertical tension members 74 and 76 mounted therein as will be explained.

The block member 55 is of thickness equal to or greater than the outside diameter of the frame compression tube 34. The main block member 55 may be fabricated from aluminum plate or be an aluminum casting.

The cylindrical lugs 58 are adapted to receive the outer ends of the respective frame compression tube members 34 thereabout and held in an assembled condition as by an adhesive material 54.

As shown in FIG. 6, a central support ring assembly 48 is provided with a lateral support ring 46 having openings 50 for ring support rods 36 and a compression tube opening 52 to guide and laterally support the central compression tube assembly 24. The support ring 46 is of a thickness slightly greater than an outside diameter of the ring support rods 36.

The ring support rod openings 50 in the support ring assembly 48 are adapted to receive the respective ends of the ring support rods 36 and anchored therein as by use of the adhesive material 54.

The compression tube opening 52 is operable to receive and laterally support a portion of the central compression tube assembly 24 therein as will be described.

The entire assembled lightweight, prestressed tower 12 is pivotal about the spaced pivot support angles 66 from the horizontal condition as shown in dotted lines in FIG. 1 being a final step in the assembly process. The lightweight, prestressed tower 12, is pivoted upwardly as noted by the arrow 180 to the vertical position as shown in solid lines in FIG. 1. In this condition, the corner anchor fixture 67 is secured as by nut and bolt members to the base support pad 14.

The pivot fixtures 70 and the corner anchor fixture 67 have the upper surfaces 72 thereon to receive and support corner anchor block assemblies 96 thereon which are secured thereto as by welding. The corner anchor block assemblies 96 are a part of the base load transfer assembly 20.

Figure 5:
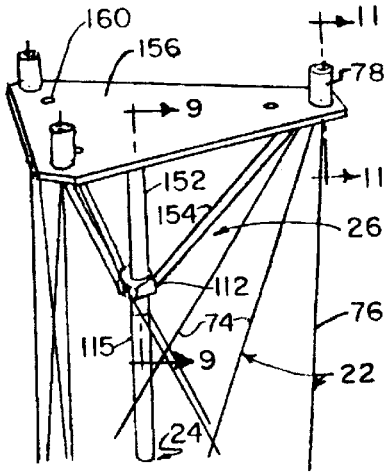
FIG. 5 is a fragmentary perspective view of an upper portion of the lightweight prestressed tower of this invention.
Figure 2:
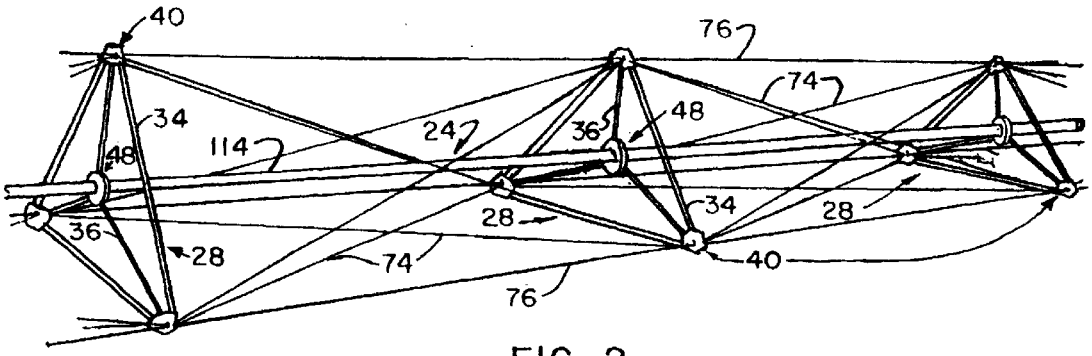
FIG. 2 is a fragmentary perspective view of a portion of the lightweight, prestressed tower in the horizontal assembled position.

The primary vertical primary truss assembly 22, shown in FIGS. 2, 4, and 5, includes 1) a pair of diagonal tension members 74 and vertical tension members 76 in each vertical plane of the triangular shaped lightweight, prestressed tower 12, located between each horizontal frame assembly 28 and extending through corner anchor block assemblies 96 to end anchor chuck assemblies 78 at the exterior corners of the base load transfer assembly 20 and upper load transfer assembly 26; 2) frame compression tube members 34 in the horizontal frame assemblies 28; 3) corner anchor block assemblies 40 at the three corners of each horizontal frame assembly 28 to receive and anchor a pair of the diagonal tension members 74 and the vertical tension members 76 at each horizontal frame assembly 28.

The primary vertical truss assembly 22 is comprised of prestressed trusses in each of three faces of the triangular cross section of the lightweight, prestressed tower 12. FIGS. 2, 4, and 5 show the members and assemblies of the primary vertical truss assembly 22 which include the vertical tension members 76 and the diagonal tension members 74 which extend from the base load transfer assembly 20 to the upper load transfer assembly 26. The tension members 74, 76 are attached to corner anchor block assemblies 40 at each of the three corners of a plurality of equally spaced horizontal frame assemblies 28 and are anchored at the three corners of the base load transfer assembly 20 and upper load transfer assembly 26 by corner anchor block assemblies 96 and end anchor chuck assemblies 78; and frame compression tube members 34 are in each of the three faces of a plurality of equally spaced frame assemblies 28. These frame compression tube members 34 are attached to corner anchor block assemblies 40 at each corner of the horizontal frame assemblies 28.

A vertical truss is formed in each vertical plane of the triangular shaped tower when the upper load transfer assembly 26 is forced outward from the base load transfer assembly 20 by extending the central compression tube assembly 24 by means of the expandable screw assembly 118 when prestressing the tower 12. The vertical tension members 76 become the chords of the trusses and the diagonal tension members 74 and the frame compression tube members 34 become the webs of the trusses which cantilever from the base support fixture assembly 30. Design horizontal loads on the lightweight, prestressed tower 12 and its appurtenances are resisted by suitably sized truss members. The initial tension in the vertical tension members 76 being compressed by the bending loads accept these compression forces by a reduction in the initial tension in these members. Through design, sufficient tension is introduced in the vertical chord members to assure adequate tension remains in the chord being compressed by the bending loads and that additional tension in the chords being tensioned by the bending loads remain within the allowable stress limits for these chords.

The diagonal and vertical tension members 74, 76 are preferably constructed of a high strength galvanized steel cable or other flexible high tensile strength material which provides proper strength and thickness to meet the requirements of the overall engineering design of the lightweight, prestressed tower 12 of this invention.

Figure 11:
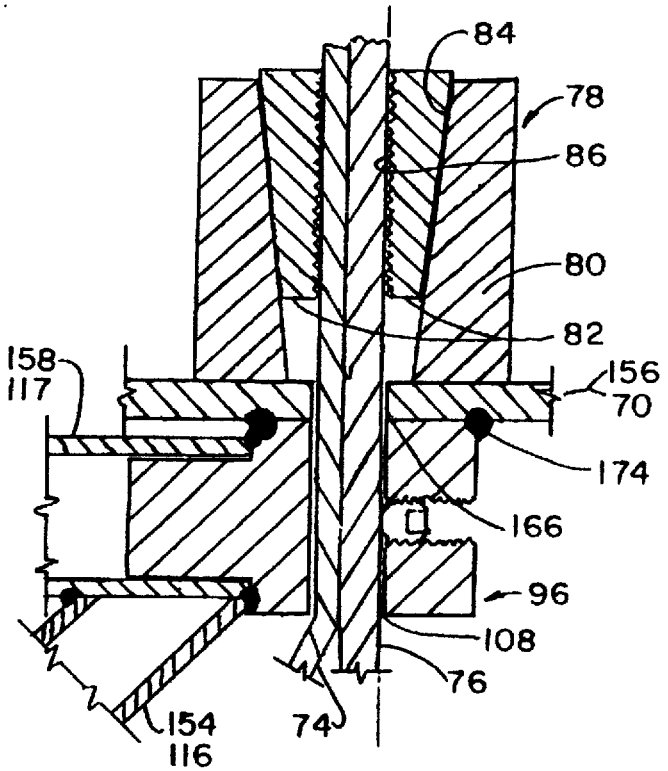
FIG. 11 is an enlarged fragmentary sectional view taken along line 11—11 in FIGS. 4 and 5.

As shown in FIG. 11, the end anchor chuck assembly 78 includes a chuck body 80 of cylindrical shape and chuck jaws 82. The chuck body 80 is provided with a central conical chuck body opening 84 therein. The chuck jaws 82 are tapered on an outer surface to fit within the tapered chuck body opening 84 and having a central cylindrical opening 86.

The chuck jaws 82 are adapted to receive outer ends of the diagonal and vertical tension members 74, 76 which will be pulled downwardly within the conical chuck body openings 84. This will cause a movement of the chuck jaws 82 inwardly and provide for a clamping about the diagonal and vertical tension members 74, 76. This is a well known wedge type connection whereupon greater pulling on the diagonal and vertical tension members 74, 76 operate to increase a locking force against further axial movement.

Each horizontal frame assembly 28 shown in FIG. 6 is provided with 1) three frame compression tubes 34; 2) three radial ring support rods 36; 3) three corner anchor block assemblies 40; and 4) a central support ring assembly 48. The central support ring assembly 48 guides and laterally supports the central compression tube assembly 24 and is itself held in a stable central location by the three radial ring support rods 36 which are attached as by adhesive to the lateral support ring 46 and three corner anchor block assemblies 40 which are prevented from lateral movement by the diagonal tension members 74 in each tower face. The frame compression tubes 34 are interconnected to spaced ones of the three corner anchor block assemblies 40 in each frame and secured thereto as by an adhesive material 54. The corner anchor block assemblies 40 are identical for each individual tower design and tower taper is easily obtained by shortening the length of the frame compression tube 34 for each higher horizontal frame assembly 28.

Referring to FIG. 6, the corner anchor block assemblies 40 are provided with the main block member 55 including the tension member opening 56 and the transverse threaded hole 62 to receive the anchor allen screw 64 therein and are provided with radial ring support rod openings 50 to receive the radial ring support rod 36. Cylindrical lugs 58 are provided to receive the respective ends of frame compression tubes 34 which are secured as by an adhesive material 54.

As also shown in FIG. 6, the central support ring assembly 48 is as previously described having the lateral support ring 46 with the ring support rod openings 50 and central compression tube opening 52 therein.

Figure 7:
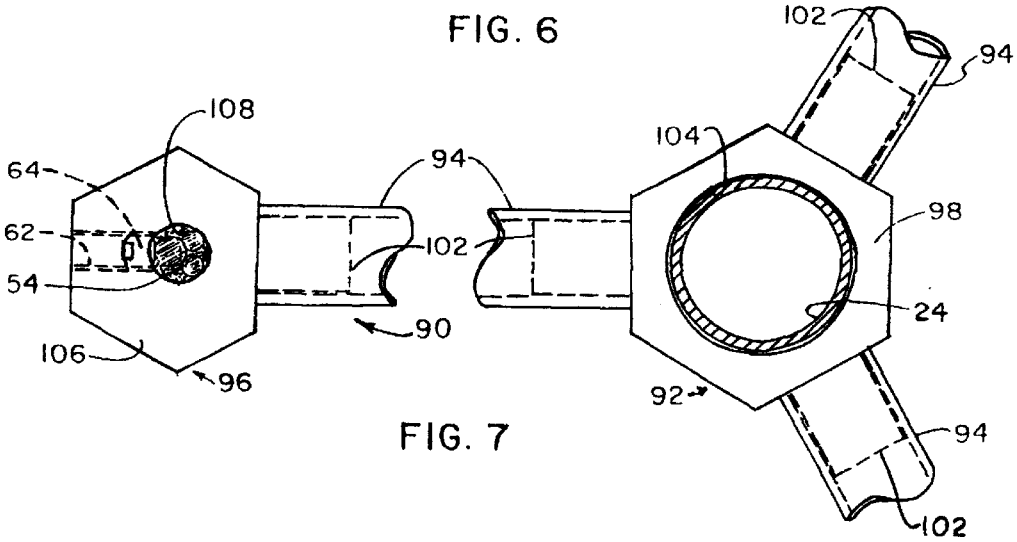
FIG. 7 is a foreshortened fragmentary sectional view taken along line 7—7 in FIG. 3.
Figure 10:
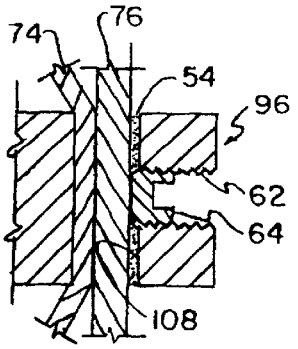
FIG. 10 is an enlarged fragmentary sectional view taken along line 10—10 in FIGS. 3 and 4.

FIG. 10 illustrates a method of initially anchoring with set screws 64 a pair of diagonal tension members 74 and a vertical tension member 76 in tension member openings 56, 108 in corner anchor block assemblies 40 and 96 shown in FIGS. 6 and 7. After adjustments, if required, permanent anchorage is then accomplished by bonding as with adhesive 54 between tension members and an interior surface of the tension member openings 56, 108.

Figure 3:
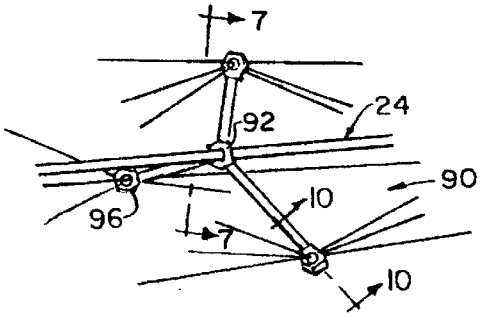
FIG. 3 is a fragmentary perspective view of a second embodiment of a radial horizontal frame assembly of the lightweight, prestressed tower of this invention.

As shown collectively in FIGS. 3 and 7, a second embodiment of the lightweight, prestressed tower 12 is provided which includes a radial horizontal frame assembly 90 having 1) a central hub assembly 92; 2) radial compression tubes 94; and 3) corner anchor block assemblies 96.

The central hub assembly 92 includes a lateral support ring 98 having laterally extended cylindrical lugs 102, namely three thereof, and a compression tube opening 104. The cylindrical lugs 102 are adapted to receive inner ends of the radial compression tubes 94 thereon and further secured thereto by the adhesive material 54.

The central compression tube opening 104 is operable to guide and laterally support the central compression tube assembly 24 therethrough as will be explained.

The radial compression tubes 94 have outer ends thereof connected to cylindrical lugs 102 extending from a respective one of the three corner anchor block assemblies 96.

Each corner anchor block assembly 96 includes 1) a hex anchor block member 106; 2) a tension member opening 108; and 3) a cylindrical lug 102. The hex anchor block member 106 is preferably constructed of a material thickness equal to or exceeding the diameter of the radial compression tubes 94 utilized therewith.

The tension member opening 108 is provided with a transverse threaded hole 62 and an anchor allen screw 64 is mounted therewithin so as to secure the diagonal and vertical tension members 74, 76 in combination with the adhesive material 54, to provide permanent anchorage.

Each cylindrical lug 102 is operable to receive the outer end of a respective radial compression tube 94 thereon which can be further secured thereto by use of the adhesive material 54.

The central compression tube assembly 24 includes 1) a lower compression tube member 113; 2) intermediate compression tube member 114; and 3) an upper compression tube member 115.

Lower, intermediate, and upper central compression tube members 113, 114, and 115 are provided with alignment inserts 120 bonded as by adhesive material 54 into one end of each compression tube member so as to be telescopingly placed in the other end of adjacent tube members, accurately aligning the tubes and maintaining the alignment. The lengths of the tube members which make up the central compression tube assembly 24 are, as a minimum, equal to the center-to-center spacing of the horizontal frame assemblies 28 or may be two, three, or more times the spacing length, but not longer than the length required to minimize shipping costs. Joints in the central compression tube assembly 24 are located at the vertical centerlines of the horizontal frame assemblies 28. The alignment inserts 120 provides for a plurality of intermediate compression tube members 114 to be joined with adjacent ones thereof to provide the overall central compression tube assembly 24 length as required depending on the height of the lightweight, prestressed tower 12 being constructed.

As noted in FIG. 5, the upper compression tube member 115 is engageable with a central support tube 152 of the upper load transfer assembly 26.

As shown in FIG. 8, the expandable screw assembly 118 includes 1) a main threaded member 130; 2) adjustable nut members 134; 3) washer members 132 mounted on the outer ends of the main threaded member 130 and having abutting thereagainst the adjustable nut members 134. The main threaded member 130 has an upper end engageable and mounted within the lower tubular section 113 of the central compression tube assembly 24 which a lower end is engageable and mounted within and extended through the central support tube 38 of the base load transfer assembly 20. The tower 12 is prestressed by rotating and moving the adjustable nut members 134 outwardly about the main threaded member 130, forcing the central compression tube assembly 24 outward. The prestressing force is applied by adjusting the nut members 134 to a given adjusted position on the main threaded member 130. The tower 12 may also be prestressed by hydraulic force against the lower end of the main threaded member 130 and retained by seating the lower adjustable nut member 134 against the central support tube 38.

Figure 9:
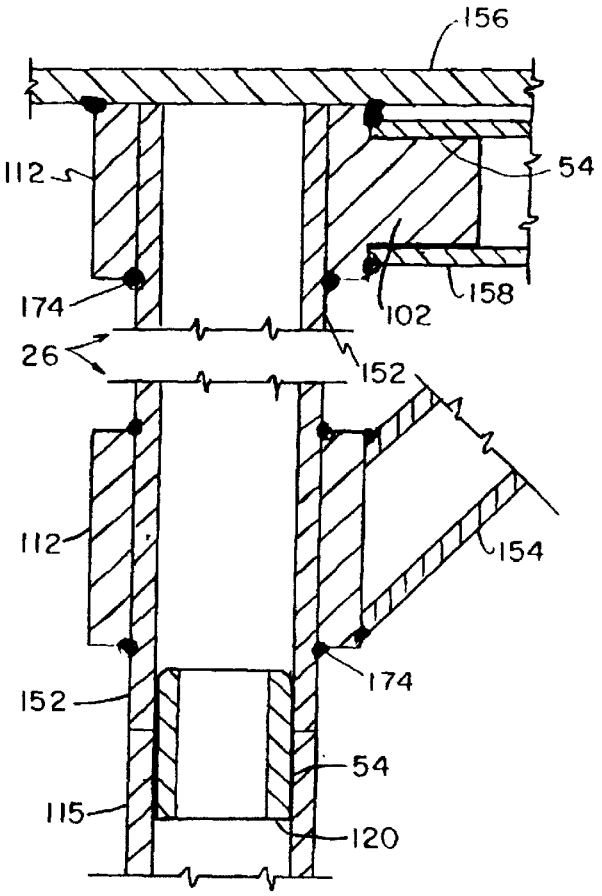
FIG. 9 is an enlarged foreshortened fragmentary sectional view taken along line 9—9 in FIG. 5.

As shown in FIGS. 5, 9, and 11, the upper load transfer assembly 26 includes 1) a triangular support plate 156; 2) a central support tube 152; 3) support rings 112; 4) radial tension tubes 158; 5) radial diagonal compression tubes 154; and 6) corner anchor block assemblies 96.

The radial diagonal compression tubes 154 and radial tension tubes 158 are secured at their outer ends as by welding to the corner anchor block assemblies 96 which are secured as by welding to the triangular support plate member 156. At their inner ends, the radial diagonal compression tubes 154 and radial tension tubes 158 are secured as by welding to support rings 112 which are secured as by welding to the central support tube 152.

The triangular support plate member 156 provides the necessary rigidity to secure a mast 17 for mounting antennae 16 or other elevated equipment using equipment anchor holes 160.

USE AND OPERATION OF THE INVENTION

In the use and operation of the lightweight, prestressed tower 12 of this invention, it is preferably pre-constructed and assembled at a manufacturing site in order to meet certain specifications regarding 1) overall height of the lightweight, prestressed tower assembly 12; 2) loads to be placed on the upper load transfer assembly 26; 3) exposure to various wind loads thereagainst; and 4) size, weight, and diameter of various tubular material to be used therein for the base load transfer assembly 20, the horizontal frame assembly 28, and the central compression tube assembly 24.

All of these load conditions are predetermined and engineered into the overall lightweight, prestressed tower 12, including tension and compression loads to be utilized thereon through the diagonal and vertical tension members 74, 76. More particularly, the lightweight, prestressed tower 12 is pre-engineered and assembled at the manufacturing site to meet the load, size, and stress requirements.

The base support load transfer assembly 20 is first assembled and then interconnected to a base support fixture assembly 30 which is adapted to be eventually secured to the support base pad 14. The base load transfer assembly 20 is then interconnected to a lower portion of the primary truss assembly 22 in an assembly fixture. The diagonal and vertical tension members 74, 76 are extended through the tension member opening 108 in the respective corner anchor block assemblies 96 and received by the end anchor chuck assemblies 78.

The diagonal and vertical tension members 74, 76 are then extended outwardly in respective planes to be attached to an adjacent one of the horizontal frame assembly 28 of the primary truss assembly 22.

Further, in all horizontal frame assemblies 28, the diagonal and vertical tension members 74, 76 are mounted through the respective tension member openings 56 and secured in the corner anchor block assemblies 40 by the anchor allen screw 64 mounted in the threaded anchor hole 62 so as to have a binding effect against the diagonal and vertical tension members 74, 76 mounted therein. The adhesive material 54 is added to the respective tension member openings 56 to achieve a film locking condition as shown in FIGS. 6. Further, this locking feature with the anchor allen screw 64 is shown in FIG. 10.

Then, the diagonal and vertical tension members 74, 76 are extended outward and connected to the other one of the horizontal frame assemblies 28 in the primary truss assembly 22.

This procedure is repeated outwardly until reaching the outermost ones of the horizontal frame assemblies 28 of the primary truss assembly 22 to be utilized. These are constructed in equally spaced sections.

Finally, the upper one of the horizontal frame assembly 28 of the primary truss assembly 22 is connected by the diagonal and vertical tension members 74, 76 to the upper load transfer assembly 26 as noted in FIG. 5.

The upper, outer end of the diagonal and vertical tension members 74, 76 are mounted through the respective tension member opening 108 in a respective corner anchor block assembly 96 and the cable receiver holes 166 in the triangular support plate 156 and secured thereto by respective ones of the end anchor chuck assemblies 78 as noted in FIG. 11.

The central compression tube assembly 24 has been mounted in a central position in the lightweight, prestressed tower 12 with the lower end secured to the base load transfer assembly 20 by means of the expandable screw assembly 118.

Compression tube members 113, 114, 115 having been joined to each other and mounted within the central support ring assemblies 48 of the horizontal frame assemblies 28 so as to provide an important central compression tube extending from the top to bottom of the overall lightweight, prestressed tower 12.

The alignment insert 120 of the top one of the upper compression member 115 is mounted within the central support tube 152 of the upper load transfer assembly 26.

In this factory assembly condition, the technician at the manufacturing site would then proceed to utilize the expandable screw assembly 118 or apply hydraulic force to the lower end of the main threaded member 130 to initially prestress the lightweight, prestressed tower 12.

More specifically, the adjustment nut members 134 would be expanded outwardly and longitudinally on the main screw member 130 in order to achieve the proper and desirable tensioning of the diagonal and vertical tension members 74, 76 and compression of the frame compression tubes 34 and the central compression tube assembly 24, thus creating prestress vertical truss structures in three faces of the tower 12.

When this desirable pretensioning has been achieved to meet engineering specifications, the manufacturer's technician would then properly mark this adjusted position on the main screw member 130 so that an exact assembly can be achieved at an assembly site by an erector of the lightweight, prestressed tower assembly 12.

Next, the prestress in the lightweight, prestressed tower 12 is removed at the manufacturing site with the central compression tube assembly 24 disassembled into individual ones so as to be easily shipped to the erection assembly site.

Further, the base load transfer assembly 20 and the upper load transfer assembly 26 are collapsed with the tension diagonal and vertical tension members 74, 76 and the horizontal frame assemblies 28 of the truss assemblies 22 to a small height for ease of packaging and shipping.

At the assembly site, the lightweight, prestressed tower 12 will then be expanded and erected as previously described at the manufacturing site to the desired engineering specifications.

Site assembly entails inserting the compression tube members 113, 114, 115 through the lateral support rings 46 of the horizontal frame assembly 28 inserting the expandable screw assembly 118 between the lower compression tube member 113 and the base load transfer assembly 20.

In this final assembly procedure, the adjustment nut members 134 are expanded outwardly on the main screw member 130 to achieve and retain the pretensioning and compression load characteristics thereto which was first engineered and preset at the manufacturing site.

It is noted that the overall lightweight, prestressed tower 12 may be constructed of various sizes of the horizontal frame assembly 28 to achieve the tapered shape from the lower base load transfer assembly 20 to the upper load transfer assembly 26 as shown in FIG. 1.

Further, the second embodiment of the radial horizontal frame assembly 90, as shown in FIGS. 3 and 7, may be utilized which provides a simplified construction not requiring the outer compression tube members 34 which are required in the first embodiment of this invention.

In the second embodiment, the ring support rods 36 of the first embodiment are replaced with the more substantial and sturdy inner compression tubes 94 mounted on the respective cylindrical lugs 102 as noted in FIG. 7 to achieve the same overall functional operation but with a different horizontal frame assembly configuration.

The lightweight, prestressed tower 12 is constructed of flexible, high strength, lightweight diagonal and vertical tension members 74, 76 and utilizing tubular aluminum members to provide for horizontal and vertical compression members.

The lightweight, prestressed tower assembly is readily pre-engineered, erected, and disassembled at a manufacturing site; and provided in a disassembled compact nature for ease and inexpensive shipping to an erection site;

While the invention has been described in conjunction with preferred specific embodiments thereof, it will be understood that this description is intended to illustrate and not to limit the scope of the invention, which is defined by the following claims:

We claim:

1. A lightweight, prestressed tower movable from a collapsed, storage, transport condition to a fully extended, prestressed tower, comprising:

a) a base load transfer assembly adapted to be connected to a base support fixture assembly, pivotally connected to a base support pad;

b) a primary truss assembly connected to said base load transfer assembly;

c) an upper load transfer assembly connected to said primary truss assembly;

d) a central compression tube assembly connected to and mounted between said upper load transfer assembly and said base load transfer assembly; and e) said central compression tube assembly adjustable and expandable axially to increase an overall length of said central compression tube assembly and create a predetermined tension force on said primary truss assembly and a predetermined compression force on said central compression tube assembly.

2. A method of constructing a lightweight, prestressed tower using a) a base load transfer assembly; b) a primary truss assembly; c) a central compression tube assembly; and d) an upper support load transfer assembly, comprising the following steps:

a) securing a base load transfer assembly to a primary truss assembly;

b) connecting said primary truss assembly to an upper load transfer assembly;

c) mounting a rigid central compression tube assembly between said base load transfer assembly and said upper load transfer assembly; and d) adjusting and expanding said central compression tube assembly to increase an overall length thereof and place a tension load on said primary truss assembly and a compression load on said central compression tube assembly, forming vertical tendon trusses in the three tower faces;

whereby said lightweight, prestressed tower is held in an extended, erected condition by the tension and compression forces present therein.

3. A lightweight, prestressed tower as described in claim 1, including:

a) a plurality of ones of said primary truss assembly are interconnected to each other and said central compression tube assembly between said upper load transfer assembly and said base load transfer assembly to construct said lightweight, prestressed tower of a desired overall length;

b) each of said primary truss assemblies includes spaced horizontal frame assemblies interconnected by a tension tendon assembly having diagonal tension members and vertical tension members, all interconnected at outer ends thereof to respective outer ends of said horizontal frame assemblies; and c) said base load transfer assembly is expanded to present preselected compression load forces on said horizontal frame assemblies and preselected tension load forces on said diagonal tension members and said vertical tension members.

4. A lightweight, prestressed tower as described in claim 1, wherein:

a) said primary truss assembly includes a tension tendon assembly having interconnected diagonal tension members connected to vertical tension members connected at adjacent outer ends to respective horizontal frame assemblies and being formed in vertical tension trusses in three tower faces to provide tension forces therebetween; and b) outer ends of said diagonal tension members interconnected to respective upper and lower ones of said vertical tension members to achieve a predetermined tension force therebetween and predetermined compression forces in said horizontal frame assemblies when in the extended assembled condition.

5. A lightweight, prestressed tower as described in claim 1, wherein:

a) said base load transfer assembly includes radial horizontal tension members interconnected at outer ends to said primary truss assembly and having radial diagonal compression members connected at one end to said radial horizontal tension members and at an upper end being adjustably connected to said central compression tube assembly; and b) said upper end of said radial diagonal compression members are selectively movable relative to said central compression tube assembly to increase and decrease tension and compression forces in said primary truss assembly by expanding and increasing an overall length of said central compression tube assembly.

6. A lightweight, prestressed tower as described in claim 5, wherein:

a) said base load transfer assembly includes corner block assemblies at each exterior corner thereof connected to said radial diagonal compression members and said radial horizontal tension members and said primary truss assembly to receive and transfer tension and compression forces therebetween when in the assembled condition; and b) said central compression tube assembly includes an adjustable bottom tube assembly engageable with said radial diagonal compression members and operable to cause expanded movement and increase in length of said bottom tube assembly to regulate the amount of tension and compression forces within said primary truss assembly.

7. A lightweight, prestressed tower as described in claim 5, wherein:

a) said upper load transfer assembly includes a main top support plate member interconnected to diagonal compression struts to an upper portion of said primary truss assembly to transfer compression forces to said central compression tube assembly on expansion in length; and b) said main top support plate member operable to receive and support an antenna or other equipment requiring elevated mounting thereon.

8. A lightweight, prestressed tower as described in claim 7, wherein:

a) said upper load transfer assembly includes a central support tube connected to said main top support plate member and said central compression tube assembly; and b) said main top support plate member movable on expanded adjustment movement of said central compression tube assembly to achieve predetermined tension and compression forces in said primary truss assembly.

9. A lightweight, prestressed tower as described in claim 1, wherein:

a) said central compression tube assembly includes an adjustable and expandable compression tube assembly mounted between said base load transfer assembly and said upper load transfer assembly;

b) said primary truss assembly includes spaced horizontal frame assemblies interconnected by diagonal tension members and vertical tension members; and c) said horizontal frame assemblies operably connected to said adjustable compression tube assembly and operable to transfer compression forces therebetween.

10. A lightweight, prestressed tower adapted to be mounted on a base support pad, comprising:

a) a base load transfer assembly connected to a base support pad and movable from a horizontal assembled condition to a vertically extended usage condition;

b) a primary truss assembly having a first portion connected to said base load transfer assembly and a second portion connected to an tipper load transfer assembly;

c) a central compression tube assembly connected between said base load transfer assembly and said upper load transfer assembly and operably connected to said primary truss assembly; and d) said central compression tube assembly is predetermined tension and compression forces on said primary truss assembly.

11. A lightweight, prestressed tower as described in claim 10, wherein:

a) said primary truss assembly includes a pair of spaced horizontal frame assemblies interconnected by a tension tendon assembly;

b) said horizontal frame assembly movable axially on said central compression tube assembly; and c) said tension tendon assembly includes diagonal tension members and vertical tension members, each interconnected to each other at outer ends of said horizontal frame assembly having predetermined and pre-engineered tension forces therebetween.

12. A lightweight, prestressed tower as described in claim 10, wherein:

a) said base load transfer assembly includes interconnected horizontal tension members and diagonal compression members having outer ends connected to corner fixtures;

b) inner ends of said diagonal compression members operable connected to an expandable screw assembly which is connected to said central compression tube assembly; and c) said expandable screw assembly adjustably operable to achieve predetermined compression and tension forces in said primary truss assembly.

13. A lightweight, prestressed tower as described in claim 12, wherein:

a) said primary truss assembly having tension members connected to said corner fixtures to transfer predetermined tension forces between said base load transfer assembly and said upper load transfer assembly; and b) predetermined compression forces are transferred to said diagonal compression members and said central compression tube assembly.

14. A lightweight, prestressed tower as described in claim 11, wherein:

a) said horizontal frame assemblies each include radial compression tubes secured at outer ends to respective corner anchor block assemblies supporting said diagonal tension members and said vertical tension members; and b) inner ends of said radial compression tubes secured to a central hub assembly which is mounted on said central compression tube assembly operable to receive and transmit horizontal predetermined compression forces therebetween.

15. A lightweight, prestressed tower as described in claim 11, wherein:

a) said base load transfer assembly, said primary truss assembly, said central compression tube assembly, and said upper load transfer assembly initially assembled and expanded to place calculated pre-engineered and predetermined tension and compression forces on said primary truss assembly;

whereby the lightweight and prestressed tower is disassembled for shipping and operable to be reassembled on a construction site customized to required engineering specifications for intended usage.

16. A lightweight, prestressed tower as described in claim 1, wherein:

a) said central compression tube assembly includes interconnected rigid tube members mounted between said base load transfer assembly and said upper load transfer assembly; and b) said primary truss assembly includes horizontal frame assemblies mounted on said tube members and having vertical tension members and diagonal tension members interconnecting adjacent ones of said horizontal frame assemblies operable to create predetermined and pre-engineered compression forces therein when in an extended, prestressed condition.

* * * * *